US012377334B2

(12) United States Patent
Sweeney et al.

(10) Patent No.: US 12,377,334 B2
(45) Date of Patent: Aug. 5, 2025

(54) CLIMBING WALL WITH MOVABLE WALL PANEL

(71) Applicant: Everlast Climbing Industries, Inc., Crystal, MN (US)

(72) Inventors: Joseph Sweeney, Minneapolis, MN (US); Timothy S. Sudeith, Edina, MN (US); Sarah Mae Howard, Lakeville, MN (US); Nicolas Oklobzija, White Bear Lake, MN (US)

(73) Assignee: Everlast Climbing Industries, Inc., Crystal, MN (US)

( * ) Notice: Subject to any disclaimer, the term of this patent is extended or adjusted under 35 U.S.C. 154(b) by 0 days.

(21) Appl. No.: 18/232,515

(22) Filed: Aug. 10, 2023

(65) Prior Publication Data

US 2024/0050827 A1 Feb. 15, 2024

Related U.S. Application Data

(60) Provisional application No. 63/397,099, filed on Aug. 11, 2022.

(51) Int. Cl.
*A63B 69/00* (2006.01)

(52) U.S. Cl.
CPC ..... *A63B 69/0048* (2013.01); *A63B 2225/09* (2013.01)

(58) Field of Classification Search
CPC ..... A63B 69/0048; A63B 2225/09; A63B 2225/50; A63B 9/00
See application file for complete search history.

(56) References Cited

U.S. PATENT DOCUMENTS

| | | | | |
|---|---|---|---|---|
| 2002/0022552 | A1* | 2/2002 | Yoshida | A63B 69/0048 482/37 |
| 2007/0082791 | A1* | 4/2007 | Reese | A63B 9/00 482/37 |
| 2020/0023257 | A1 | 1/2020 | Speed et al. | |
| 2020/0171369 | A1* | 6/2020 | Sudeith | A63B 69/0048 |
| 2020/0248451 | A1* | 8/2020 | Sudeith | E04C 3/005 |
| 2021/0245026 | A1 | 8/2021 | Sudeith et al. | |
| 2021/0283477 | A1* | 9/2021 | Lodwick | A63B 22/001 |

FOREIGN PATENT DOCUMENTS

| | | | | |
|---|---|---|---|---|
| CN | 110681138 A | * | 1/2020 | A63B 69/0048 |
| DE | 102005030439 B3 | * | 11/2006 | A63B 69/0048 |
| FR | 2613945 | | 10/1988 | |
| FR | 2977501 | | 1/2013 | |
| WO | 9531257 | | 11/1995 | |

* cited by examiner

*Primary Examiner* — Nyca T Nguyen
(74) *Attorney, Agent, or Firm* — McAndrews, Held & Malloy, Ltd.

(57) ABSTRACT

A climbing wall assembly may include a first wall portion, a second wall portion, and a movable wall panel, the front faces of which provide a substantially continuous climbing surface. The movable wall panel has a first side hingedly connected to the first wall portion and a second side slideably and hingedly connected to the second wall portion. The assembly further includes one or more actuators configured to change an angle of the first wall portion, the second wall portion, or both. By changing the relative angle between the first and second wall portions, the movable panel may be brought between closed and open positions to provide the climbing wall with different climbing challenges.

20 Claims, 11 Drawing Sheets

CLIMBING WALL WITH MOVABLE WALL PANEL

The present application claims priority to U.S. Provisional Patent Application No. 63/397,099, filed on Aug. 11, 2022, the entirety of which is incorporated by reference herein.

SUMMARY OF THE INVENTION

Embodiments of the present disclosure are directed to a movable wall panel for incorporation into a climbing wall and a climbing wall comprising the movable wall panel. At least a portion of the climbing wall, and optionally multiple portions of the climbing wall, may be configured to be moved between a variety of different incline angles. Movement of at least a portion of the climbing wall between incline angles may cause movement of the movable wall panel, thereby producing a climbing surface that provides a different climbing challenge. By changing the incline of the one or more adjustable-incline portions of the climbing wall, therefore, a variety of different climbing challenges may be produced from a single climbing wall structure.

In particular, embodiments of the present disclosure are directed to a climbing wall assembly that includes a first wall portion, a second wall portion, and one or more actuators configured to change an angle of at least one of the first wall portion and the second wall portion with respect to a vertical axis. Optionally, the one or more actuators may include a first set of actuators configured to change an angle of the first wall portion with respect to a vertical axis and a second set of actuators configured to independently change an angle of the second wall portion with respect to a vertical axis. By operation of the one or more actuators, an angle between the first wall portion and the second wall portion may be increased or decreased.

The climbing wall assembly also includes a movable wall panel having a first side and a second side, the first side being hingedly connected to one of the first wall portion and the second wall portion and the second side being slidable along the other of the first wall portion and the second wall portion. The climbing wall assembly is configured so that increasing an angle between the first wall portion and the second wall portion causes the second side of the movable wall panel to slide in a first direction (thereby producing a climbing surface having an increased surface are), and decreasing an angle between the first wall portion and the second wall portion causes the second side of the movable wall panel to slide in a second direction. Regardless of the angle between the first wall portion and the second wall portion, a front face of the first wall portion, a front face of the second wall portion, and a front face of the movable wall panel may provide a substantially continuous climbing surface.

Some embodiments of the present disclosure are directed to a climbing wall assembly that includes a first wall portion and a second wall portion. One or more actuators are operably connected to the first wall portion and configured to change an angle of the first wall portion with respect to a vertical axis, i.e. to change the incline of the first wall portion. In these embodiments, the second wall portion may either be at a fixed angle (e.g. substantially vertical) or may also be configured to change angles, e.g. by operation of a second, independently operating set of one or more actuators. The climbing wall assembly also includes a movable wall panel having a first side and a second side, the first side being hingedly connected to the first wall portion and the second side being slidably connected to the second wall portion.

The climbing wall assembly is configured so that changing the angle of the first wall portion in a first direction (e.g. increasing the angle relative to vertical) may cause the first side of the movable wall panel to rotate about the hinged connection and the second side of the movable wall panel to slide toward the first wall portion. The climbing wall assembly is also configured so that changing the angle of the first wall portion in a second, opposite direction (e.g. decreasing the angle relative to vertical) may cause the first side of the movable wall panel to rotate about the hinged connection and the second side of the movable wall panel to slide away from the first wall portion. Regardless of the incline angle of the first wall portion, a front face of the first wall portion, a front face of the second wall portion, and a front face of the movable wall panel may provide a substantially continuous climbing surface.

In some embodiments, the second wall portion may be the adjustable-incline wall portion. For instance, embodiments of the present disclosure are directed to a climbing wall assembly that includes a first wall portion, a second wall portion, and one or more actuators that are operably connected to the second wall portion and configured to change an angle of the second wall portion with respect to a vertical axis, i.e. to change the incline of the second wall portion. In these embodiments, the first wall portion may either be at a fixed angle or may also be configured to change angles, e.g. by operation of a second, independently operating set of one or more actuators. In these embodiments, however, the first wall portion is at a first angle with respect to a vertical axis (a first incline) and the second wall portion is at a second angle with respect to a vertical axis (a second incline), and the second angle is always less than or equal to the first angle. The climbing wall assembly also includes a movable wall panel having a first side and a second side, the first side being hingedly connected to the first wall portion and the second side being slidably connected to the second wall portion.

The climbing wall assembly is configured so that changing the angle of the second wall portion in a first direction (e.g. increasing the angle relative to vertical) may cause the first side of the movable wall panel to rotate about the hinged connection and the second side of the movable wall panel to slide away from the first wall portion. The climbing wall assembly is also configured so that changing the angle of the second wall portion in a second, opposite direction (e.g. decreasing the angle relative to vertical) may cause the first side of the movable wall panel to rotate about the hinged connection and the second side of the movable wall panel to slide toward the first wall portion. Regardless of the incline angle of the second wall portion, a front face of the first wall portion, a front face of the second wall portion, and a front face of the movable wall panel may provide a substantially continuous climbing surface.

In some embodiments, including that illustrated herein, both the first wall portion and the second wall portion may be adjustable-incline wall portions.

In any embodiment, the front panels of the first wall portion, the second wall portion, and the movable panel may each contain a plurality of apertures, each of which is configured to receive a climbing grip. In any embodiment, the climbing wall assembly may further include a plurality of climbing grips on the substantially continuous climbing surface.

In any embodiment, the second wall portion may include one or more tracks and the movable wall portion may include one or more gliders, each of the one or more gliders being configured to slide on one of the one or more tracks. The one or more tracks may span between a first end and a second end, the second end being positioned closer to the first wall portion and higher vertically than the first end, although other configurations are also contemplated. The one or more tracks may be positioned on a rear of the second wall portion, i.e. the side of the panel opposite the front face. The front face of the second wall portion may comprise one or more slots through which a portion of at least one of the one or more gliders may extend, such that the glider and the track, being located behind the second wall portion, are substantially concealed from and inaccessible to a climber during use of the climbing wall.

In any embodiment, hinged connection between the first side of the movable panel and the first wall portion may be between the first side of the movable panel and an edge of the first wall portion. The hinged connection may take on any of a variety of configurations, though in some embodiments the hinged connection may include one or more piano hinges. In some embodiments, the hinged connection may also be rendered inaccessible from the substantially continuous climbing surface. For example in some embodiments, the a flexible cover may be provided between the first side of the movable panel and the first wall portion, thereby concealing and rendering the hinged connection, e.g. the one or more piano hinges, inaccessible to a climber during use of the climbing wall.

In any embodiment, the climbing wall assembly may be configured such that the climbing surface formed by the front faces of the first wall portion, the second wall portion, and the movable wall panel may be brought into a position in which a minimum surface area of the climbing surface is exposed to a climber. This may occur when the second side of the movable wall panel is at its farthest location from the first wall portion, e.g. when the one or more gliders are at the first end of the one or more tracks.

In any embodiment, the climbing wall assembly may be configured such that the climbing surface formed by the front faces of the first wall portion, the second wall portion, and the movable wall panel may be brought into a position in which it is substantially planar. This substantially planar position may correspond with the second side of the movable wall panel being at its farthest location from the first wall portion, e.g. when the one or more gliders are at the first end of the one or more tracks. This substantially planar position may also correspond with the first and second wall portions each being in a substantially vertical position, although in some embodiments it is not necessary that the wall portions can be brought to a substantially vertical position.

In any embodiment, the climbing wall assembly may be configured such that the climbing surface formed by the front faces of the first wall portion, the second wall portion, and the movable wall panel may be brought into a position in which a maximum surface area of the climbing surface is exposed to a climber. This may occur when the second side of the movable wall panel is at its closest location to the first wall portion, e.g. when the one or more gliders are at a second end of the one or more tracks.

As the second side of the movable wall panel moves between the two positions described above, the surface area of the climbing surface—as well as the topography of the climbing surface—will change, thereby providing different climbing challenges.

In any embodiment, the climbing wall assembly may comprise a gap between the front face of the second wall portion and the second side of the movable panel that is relatively small. For instance, in some embodiments, the climbing wall assembly may comprise a gap between about one-sixteenth of an inch and about one-half of an inch between the front face of the second wall portion and the second side of the movable panel. As the second side of the movable panel moves toward the first wall portion, part of the second wall portion that was previously concealed behind the movable panel will become exposed and form part of the substantially continuous climbing surface. That part of the second wall portion may include one or more, and desirably a plurality of, apertures, each of which is configured to receive a climbing grip. Given the relatively small gap between the front face of the second wall portion and the second side of the movable panel, one or more climbing grips must be added to that part of the second wall portion once it becomes exposed (and removed from that part of the second wall portion before it is again concealed by the movable wall panel).

In any embodiment, the climbing wall assembly may include a first set of one or more actuators that are configured to adjust the incline of the first wall portion and a second set of one or more actuators that are configured to adjust the incline of the second wall portion. The first and second sets of actuators may be operated independently of one another, such that the angle of incline of the second wall portion may be adjusted independently from an adjustment of the angle of incline of the first wall portion. In some embodiments, changing an angle of the first wall portion in one direction (e.g. increasing the incline angle relative to vertical) may cause the second side of the movable wall panel to slide toward the first wall portion whereas changing an angle of the second wall portion in the same direction may cause the second side of the movable wall panel to slide away from the first wall portion.

In any embodiment, the climbing wall assembly may include more than one movable wall panels as described herein. The second movable wall panel may be added to the climbing wall assembly in a variety of manners.

In some embodiments, for example, the climbing wall assembly may further include a third wall portion positioned on the opposite side of the second wall portion from the first wall portion and one or more actuators configured to change an angle of the third wall portion with respect to a vertical axis, i.e. to adjust the incline of the third wall portion. A second movable wall panel may have a first side hingedly connected to the third wall portion and a second side slidably connected to the second wall portion.

The climbing wall assembly of such an embodiment is configured so that changing the angle of the third wall portion in a first direction (e.g. increasing the angle relative to vertical) may cause the first side of the second movable wall panel to rotate about the hinged connection and the second side of the second movable wall panel to slide toward the third wall portion. The climbing wall assembly is also configured so that changing the angle of the third wall portion in a second, opposite direction (e.g. decreasing the angle relative to vertical) may cause the first side of the second movable wall panel to rotate about the hinged connection and the second side of the second movable wall panel to slide away from the third wall portion. Regardless of the incline angle of the third wall portion, a front face of the second wall portion, a front face of the third wall portion, and a front face of the second movable wall panel may provide a substantially continuous climbing surface.

Independent adjustment of the first wall portion, the third wall portion, and optionally the second wall portion may thus crease a substantially continuous climbing surface having a variety of different configurations and topographies.

In some embodiments, the climbing wall assembly may further include a third wall portion positioned on the opposite side of the second wall portion from the first wall portion and a second movable wall panel having a first side hingedly connected to the second wall portion and a second side slidably connected to the third wall portion. The climbing wall assembly is configured so that changing the angle of the second wall portion in a first direction (e.g. increasing the angle relative to vertical) may cause the first side of the second movable wall panel to rotate about the hinged connection and the second side of the second movable wall panel to slide toward the second wall portion. The climbing wall assembly is also configured so that changing the angle of the second wall portion in a second, opposite direction (e.g. decreasing the angle relative to vertical) may cause the first side of the second movable wall panel to rotate about the hinged connection and the second side of the second movable wall panel to slide away from the second wall portion. Regardless of the incline angle of the second wall portion, a front face of the second wall portion, a front face of the third wall portion, and a front face of the second movable wall panel may provide a substantially continuous climbing surface. In some embodiments, both the second wall portion and the third wall portion may be adjustable-incline wall portions.

In other embodiments, for example, the climbing wall assembly may further include a third wall portion positioned on the opposite side of the first wall portion from the second wall portion. A second movable wall panel may have a first side hingedly connected to the first wall portion and a second side slidably connected to the third wall portion. The climbing wall assembly is configured so that changing the angle of the first wall portion in a first direction (e.g. increasing the angle relative to vertical) may cause the first side of the second movable wall panel to rotate about the hinged connection and the second side of the second movable wall panel to slide toward the first wall portion. The climbing wall assembly is also configured so that changing the angle of the first wall portion in a second, opposite direction (e.g. decreasing the angle relative to vertical) may cause the first side of the second movable wall panel to rotate about the hinged connection and the second side of the second movable wall panel to slide away from the first wall portion. Regardless of the incline angle of the first wall portion, a front face of the first wall portion, a front face of the third wall portion, and a front face of the second movable wall panel may provide a substantially continuous climbing surface. In some embodiments, both the first wall portion and the third wall portion may be adjustable-incline wall portions.

Other arrangements of additional wall portions, optionally adjustable-incline wall portions, and additional movable climbing panels are further contemplated without departing from the scope of the present disclosure.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
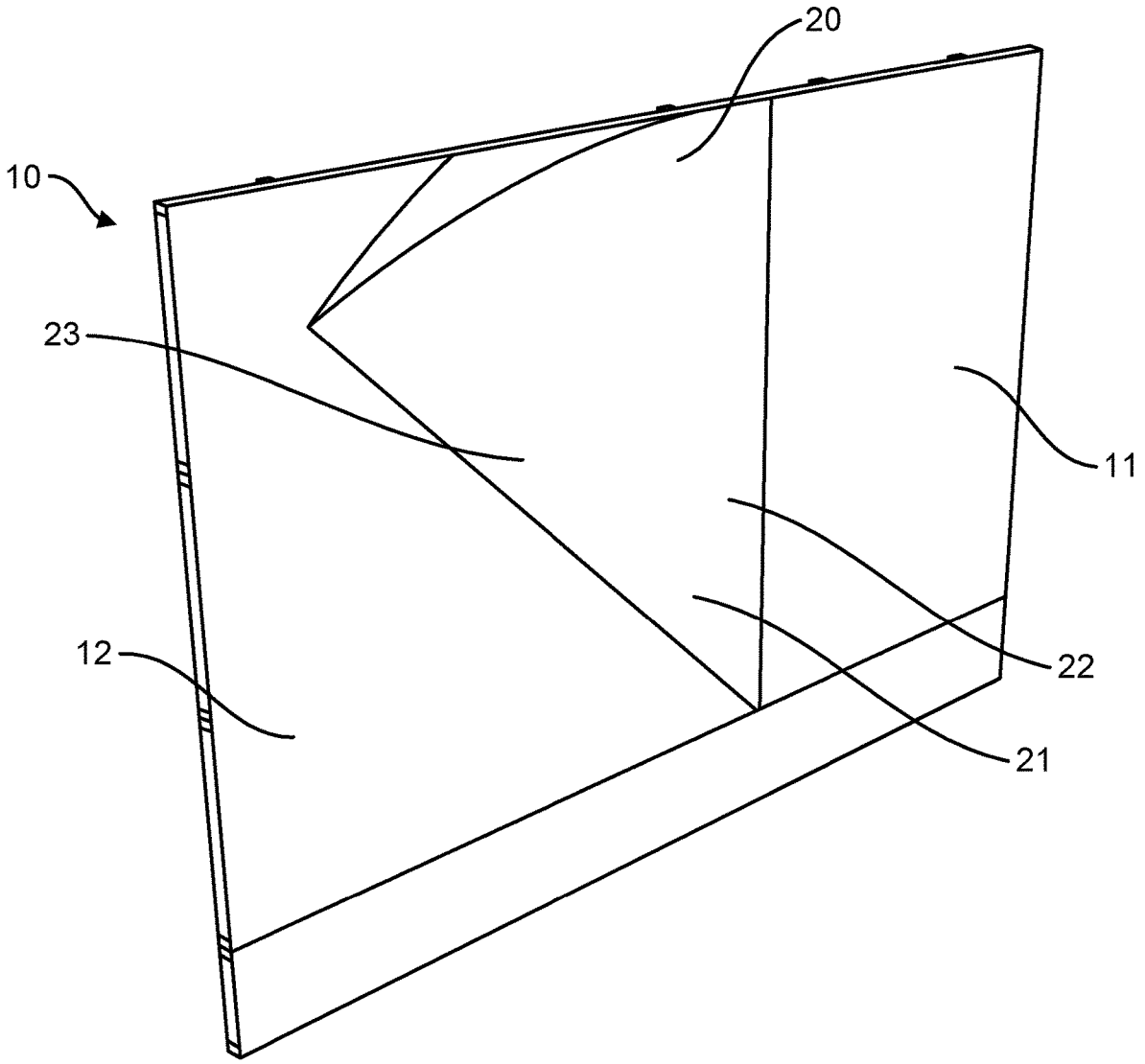
FIG. 1 is front perspective view of a climbing wall assembly according to an embodiment of the present disclosure, showing the movable wall panel in a first, retracted position.

Embodiments of the present disclosure are directed to a climbing wall assembly 10 that includes a movable wall panel 20. A climbing wall assembly 10 in accordance with an embodiment of the present disclosure is illustrated in FIGS. 1-5. In addition to the movable wall panel 20, the climbing wall assembly 10 includes a first wall portion 11 and a second wall portion 12.

At least one of the first wall portion 11 and the second wall portion 12 may be an adjustable-incline wall portion. In the illustrated embodiment, both the first wall portion 11 and the second wall portion 12 are adjustable-incline climbing wall portions, though in other (non-illustrated) embodiments, the first wall portion or the second wall portion may be non-adjustable, i.e. fixed. Examples of adjustable-incline climbing wall assemblies, e.g. actuator and support frames arrangements, of the sort that can be utilized to adjust the incline of one or more portions of the climbing wall assembly of the present disclosure may be found in United States Patent Application Publication No. 2019/0009157 A1, United States Patent Application Publication No. 2020/0171369 A1, or United States Patent Application Publication No. 2021/0245026 A1, the entireties of which are incorporated by reference herein.

Each of the first wall portion 11 and the second wall portion 12 may include one or more climbing panels 13 attached to and supported by a frame 14. The one or more climbing panels may be configured to releasably receive at least one and desirably a plurality of climbing grips (not illustrated). For example, the one or more climbing panels may have a front face that includes one or more and desirably a plurality of apertures, each of which is configured to receive a climbing grip. When a plurality of climbing grips are installed on a selection of the apertures, the front face(s) of the one or more climbing panels forms a climbing surface or a part of a climbing surface.

The frame 14 may comprise a plurality of frame elements attached to the rear face(s) of the one or more climbing panels and configured to provide the wall portion 11, 12 with sufficient strength. As illustrated, the frame 14 may include frame elements around the periphery of the wall portion 11, 12, as well as additional vertical and/or horizontal frame elements. However, other frame 14 arrangements are contemplated without departing from the scope of the present disclosure.

The climbing wall assembly 10 also includes a system for adjusting the incline of the first wall portion 11, the second wall portion 12, or both. The system includes at least one actuator 15, operation of which brings the wall portion 11, 12 to a desired angle of incline within a permitted range.

The actuator 15 may be any linear actuator that is capable of withstanding the force that may be placed on it during use of the climbing wall in an inclined position. In some embodiments, including the illustrated embodiment for example, the actuator 15 may be linear actuator such as a pneumatic linear actuator, a hydraulic liner actuator, or an electric linear actuator. In some embodiments, electric or hydraulic actuators may be preferred. In other (non-illustrated) embodiments, actuator 15 may be a ball screw actuator, a cable-based actuator, or other actuators as would be understood by those skilled in the art.

More than one actuator 15 may be utilized to adjust the incline of a wall portion 11, 12. For instance, the illustrated embodiment utilizes multiple actuators 15, and more specifically two actuators, to adjust the incline of the first wall portion 11. The multiple actuators 15 are placed side-by-side (i.e. having first ends along substantially the same horizontal plane and second ends along substantially the same horizontal plane) and are configured to operate in sync with one another. Accordingly, a user will activate the pair of actuators 15, which together will operate to bring the climbing wall portion 11 to a desired angle. The use of multiple actuators 15 in this manner helps to stabilize the wall portion 11, such as by reducing the amount of torque placed on the wall portion when a user climbs to the upper corners of the wall portion. Similarly, the illustrated embodiment also utilizes multiple actuators 15, and more specifically two actuators, to adjust the incline of the second wall portion 12. Depending on the width of the first or second wall portion 11, 12, a greater or lesser number of actuators 15 may be needed to ensure stability of the wall portion 11, 12 throughout the permitted range of incline angles.

Where both the first wall portion 11 and the second wall portion 12 are adjustable-incline wall portions, the system comprises a first set 115 of one or more actuators 15 and a second set 215 of one or more actuators. The first set of actuator(s) 115 and the second set of actuator(s) 215 are configured to operate independently from one another. In other words, a user may activate the first set of actuator(s) 115, which are associated with first wall portion 11, independently from the second set of actuator(s) 215, which are associated with the second wall portion 12. This allows a user to bring the first wall portion 11 to a first desired orientation, e.g. a desired degree of incline (without affecting the degree of incline of the second wall portion), and the second wall portion 12 to a second desired orientation, e.g. a different desired degree of incline (without affecting the degree of incline of the first wall portion).

In some embodiments, the actuator(s) 15 may be automatically activated by a user through a relatively simple user interface. For example, the climbing wall assembly 10 may comprise at least one button, switch, lever, knob, etc., or any combination thereof. For instance, a user may depress a first button to cause the actuator 15 to extend and a second button to cause the actuator to retract. Or a user may pull a lever, turn a knob, flip a switch, etc. in one of two directions to cause the actuator to extend (first direction) or retract (second direction). Or a user may pull a lever, turn a knob, flip a switch, etc. in one of two directions to indicate which movement is desired, and then press a button to activate the actuator 15 and cause the movement to occur. Accordingly, in some embodiments, a user may bring the climbing wall 10 into and out of an inclined orientation with little to no physical exertion.

In some embodiments, for example, the climbing wall assembly 10 may comprise a user interface panel. The user interface panel may be mounted to a portion of the climbing wall assembly 10. Alternatively (or additionally), a user may activate the actuator using a remote control. The remote control may be connected to the system 10 via a cord or the remote control may be wirelessly connected to the system. A docking station for the remote control may be provided on the climbing wall assembly 10. In some embodiments, a user may activate the actuator remotely through a data processing unit, or processor, such as one associated with a personal computer, a tablet computer, a smartphone, or the like.

It is also contemplated that the actuator(s) could be operated manually, such as through a variety of mechanical systems. For instance, manual activation may be included as a back-up system, in case of failure of the automatic system, or it may be the primary system by which the actuator 15 is activated. In some embodiments, for instance, the actuator 15 may be operated by way of a hand-crank or the like.

In some embodiments, the system may also include a base unit 16. The base unit 16 may support at least one end of the actuator(s) 15. In some embodiments, including the illustrated embodiment for example, each actuator 15 may have a first end hingedly mounted to the base unit 16 and a second end hingedly mounted to the framework 14 of the wall portion 11, 12. In this embodiment, the actuator 15 may be configured to adjust the incline of the climbing surface by extending, which causes an upper portion of the frame 14 (and hence the attached climbing surface) to lower in order to create a greater incline, or retracting, which causes an upper portion of the frame (and hence the attached climbing surface) to rise in order to create a lessened incline, depending on the direction in which the actuator is activated. As the actuator 15 extends or retracts, and the wall portion 11, 12 lowers or raises, the ends of the actuator will rotate about their hinged mounts.

The base unit may also support the wall portion 11, 12, and specifically the framework 14 of the wall portion, at a desired height above a ground surface. For instance, the base unit 16 may include a fixed frame element that supports the wall frame 14 in a raised position above a ground surface. As shown in the illustrated embodiment, for example, the bottom edge of the framework 14 of wall portion 11, 12 may be hingedly attached to the upper edge of the fixed frame element.

Although a particular system for adjusting the incline of wall portions 11, 12 is shown in the illustrated embodiment and described herein, alternative systems and configurations are contemplated without departing from the scope of the present disclosure.

The movable wall panel 20 also includes one or more climbing panels 21. The one or more climbing panels 21 may be configured to releasably receive a plurality of climbing grips (not illustrated). For example, the one or more climbing panels 21 may have a front face that includes a plurality of apertures, each of which is configured to receive a climbing grip. When a plurality of climbing grips are installed on a selection of the apertures, the front face(s) of the one or more climbing panels 21 forms a climbing surface or a part of a climbing surface.

Though not illustrated, in some embodiments the movable wall panel 20 may also include one or more frame elements attached to the rear face of the one or more climbing panels 21 and configured to provide the movable wall panel 20 with increased strength. The one or more frame elements may be similar to those used on the first and second wall portions 11, 12 or they may be different. In some embodiments, for instance, the one or more frame elements may comprise a continuous or substantially continuous piece of material of desired thickness affixed to the rear of the one or more climbing panels 21.

Together, the front face of the one or more climbing panels 13 of the first wall portion 11, the front face of the one or more climbing panels 13 of the second wall portion 12, and the front face of the one or more climbing panels 21 of the movable wall panel 20 provide a substantially continuous climbing surface. This means that during a climbing activity a user may navigate between the front face of the first wall portion 11, the front face of the movable wall panel 20, and the front face of the second wall portion 12 without encountering any breaks or gaps in the climbing surface defined by the front faces of each that would impair or otherwise negatively affect the climbing activity. It is noted that in some embodiments, small openings may be present on the climbing surface (e.g. between a side of the movable wall panel 20 and the first or second wall portion 11, 12) but the width of the opening may be too small to require a user to alter his or her climbing activity.

The movable wall panel 20 is defined by at least a first side 22 and a second side 23. The first side 22 is connected to the first wall portion 11 via a hinged connection 24. The hinged connection 24 may be provided by any of a variety of hinge configurations. In some embodiments, however, the hinged connection 24 may be provided by a piano hinge running between the first side 22 of the movable wall panel 20 and an edge of the first wall portion 11. The piano hinge may run along the entire span of the connection 24 between the first side 22 of the movable wall panel 20 and the first wall portion 11, though it is also contemplated that a plurality of hinge elements may instead be spaced apart from one another along the span of the connection between the first side of the movable wall panel and the first wall portion.

Desirably, the hinged connection 24 between the first side 22 of the movable wall panel 20 and the first wall portion 11 may be concealed from the climbing surface formed by the front faces of the first wall portion and the movable wall panel. By concealing the hinged connection 24 from the climbing surface, it may be ensured that a user does not place any obstructions into the hinged connection, which could cause damage to the climbing assembly 10 or, more importantly, pose a potential safety hazard. In some embodiments, for instance, the hinged connection 24 may be rendered inaccessible from the climbing surface by inclusion of a flexible cover 25 that spans between at least the first side 22 of the moveable wall panel 20 and the first wall portion 11 frontward of the one or more hinge elements.

The hinged connection 24 is configured so that the movable wall panel 20 can be brought to a plurality of different angles with respect to the first wall portion 11. In some embodiments, the plurality of angles may include an angle of about zero degrees. In some embodiments, the plurality of angles may include angles up to at least 45 degrees, angles up to at least 50 degrees, angles up to at least 60 degrees, angles up to at least 70 degrees, or angles up to at least 80 degrees. In some embodiments, for example, the moveable wall panel 20 may be brought to substantially any angle between about 0° and 45° with the first wall portion 11, substantially any angle between about 0° and 50° with the first wall portion, substantially any angle between about 0° and 60° with the first wall portion, substantially any angle between about 0° and 70° with the first wall portion, or substantially any angle between about 0° and 80° with the first wall portion.

The second side 23 of the moveable wall panel 20 is connected to the second wall portion 12 by a slidable connection 26. The slidable connection 26 may be formed by the relationship between one or more tracks 27 and one or more gliders, i.e. trolleys 28. For instance, the second wall portion 12 may include one or more tracks 27, the moveable wall portion 20 may include one or more trolleys 28, and each of the one or more trolleys may be configured to slide along one or more of the one or more tracks. In the illustrated embodiment, for example, second wall portion 12 comprises three tracks 27, though the exact number of tracks may be varied to accommodate a movable panel 20 of a desired size.

Figure 2:
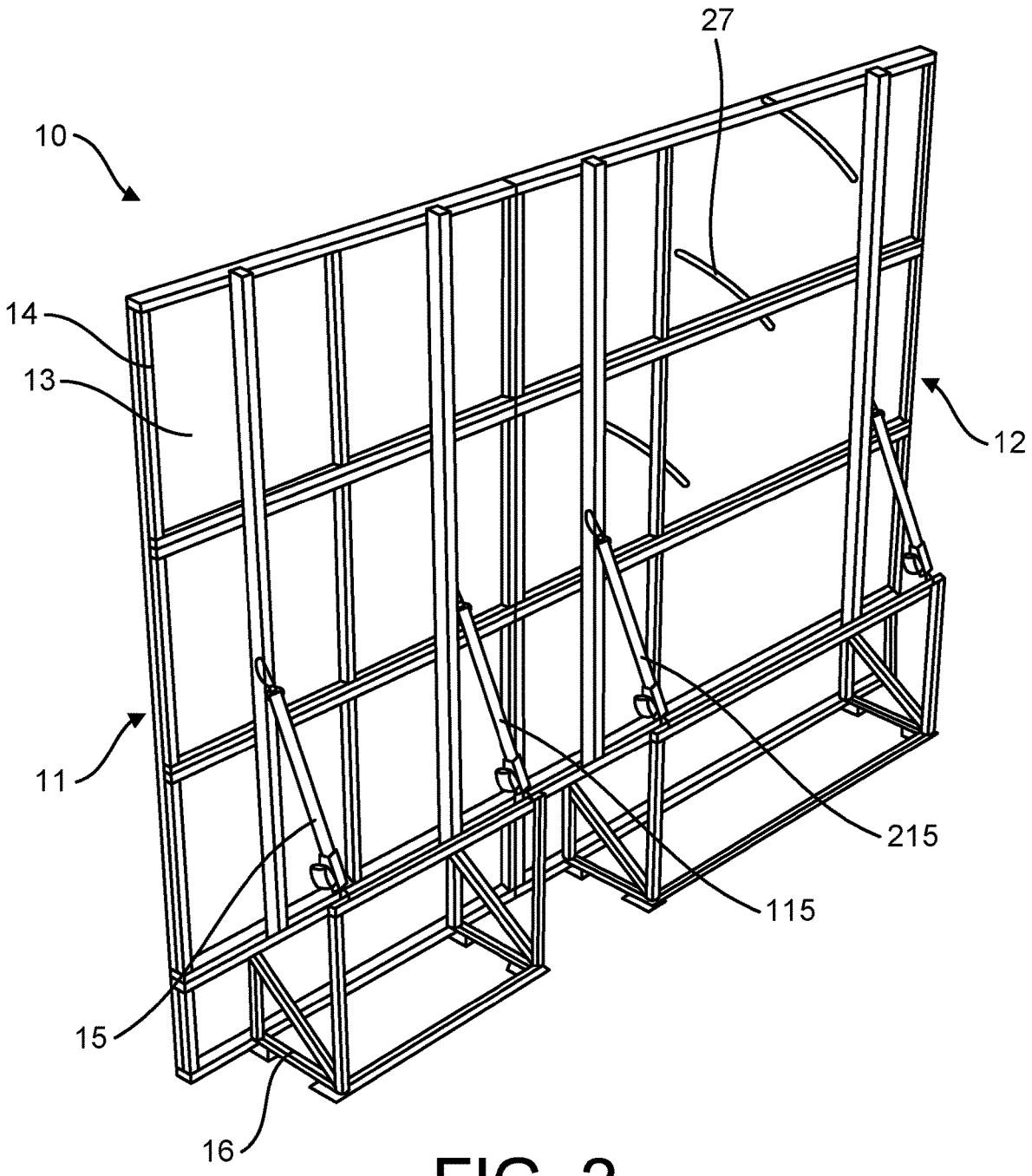
FIG. 2 is a rear perspective view of the climbing wall assembly of FIG. 1, showing the movable wall panel in a first, retracted position.
Figure 4:
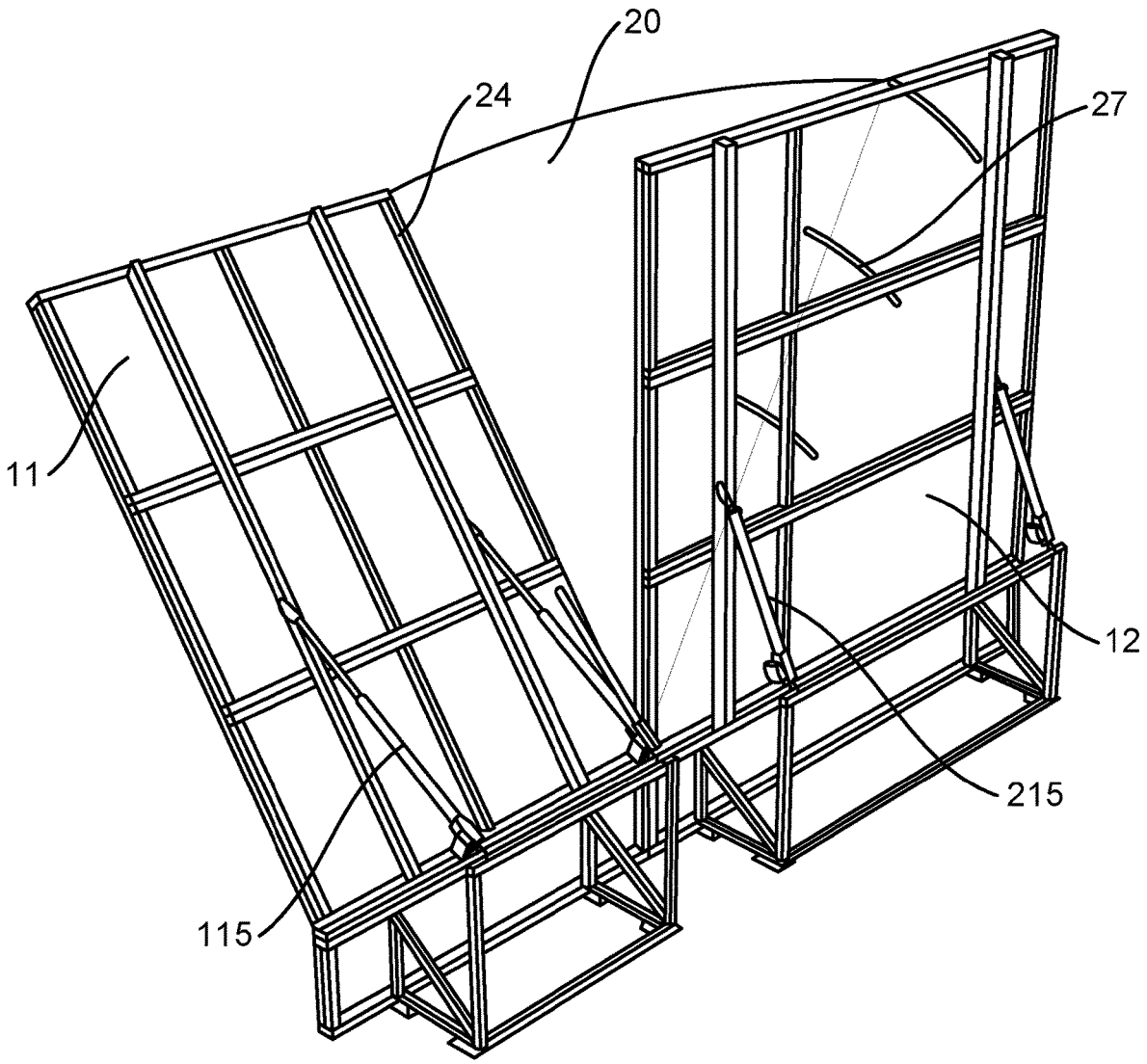
FIG. 4 is a rear perspective view of the climbing wall assembly of FIG. 1, showing the movable panel in a second, partially expanded position.
Figure 5:
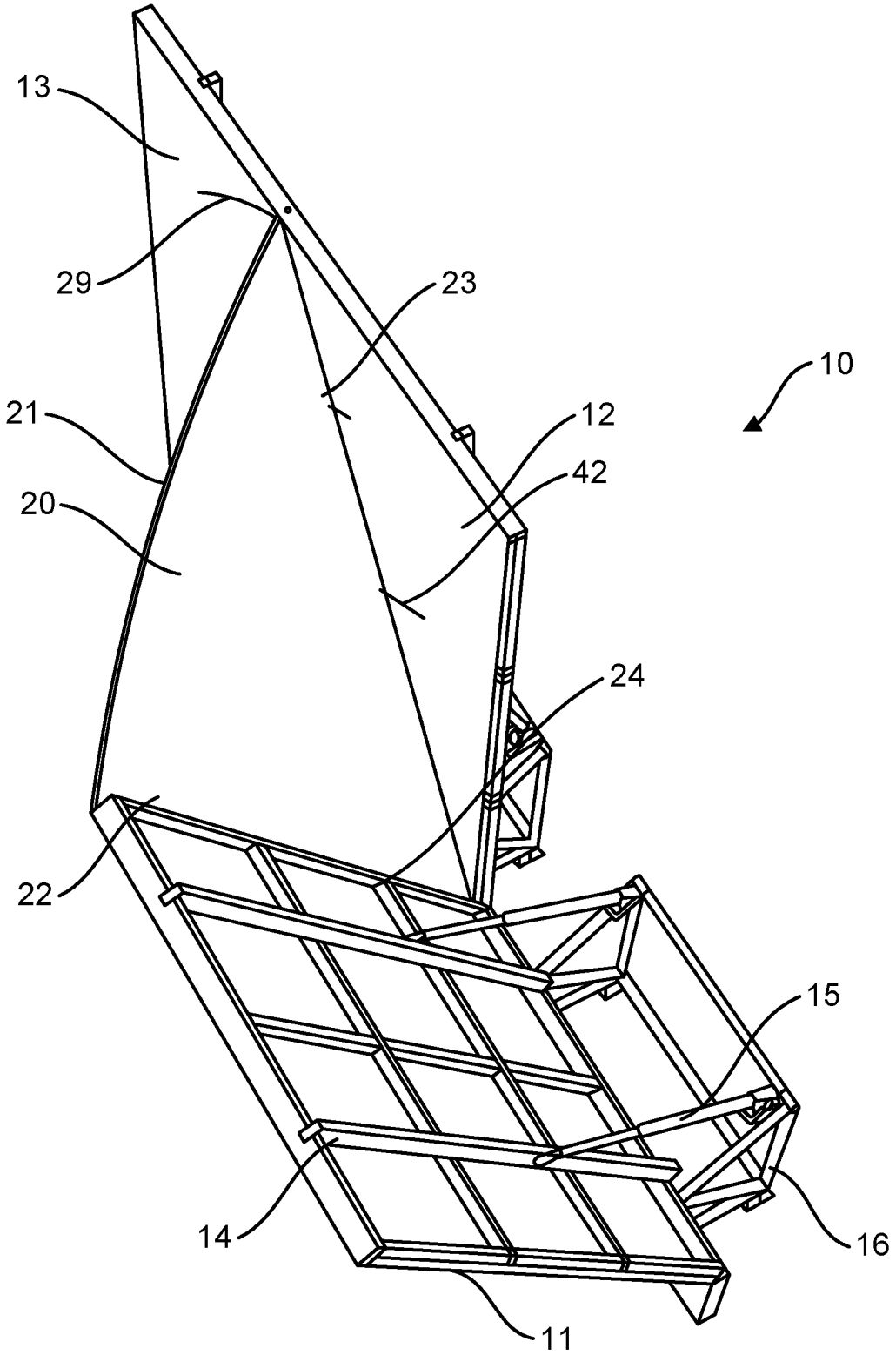
FIG. 5 is a top perspective view of the climbing wall assembly of FIG. 1, showing the movable panel in a second, partially expanded position.

As shown in FIGS. 2 and 4, each of the one or more tracks 27 may be positioned on a rear of the second wall portion 12. The second wall portion 12 may also include one or more slots 29, the one or more slots spanning between the front face of the second wall portion and the track 27 positioned on the rear of the second wall portion. Each of the one or more trolleys 28 may include a portion, e.g. mounting plate 30, that extends through at least one of the slots 29 and to which the second side 23 of the moveable wall panel 20 is connected. By positioning each of the one or more tracks 27 on the rear of the second wall portion 12 and having the track(s) only accessible from the front face of the second wall portion by a relatively narrow slot 29, it may be ensured that a user does not place any obstructions into the track, which could cause damage to the climbing assembly 10 or, more importantly, pose a potential safety hazard. It also prevents a user from attempting to utilize the track(s) as a potential climbing grip.

Figure 6:
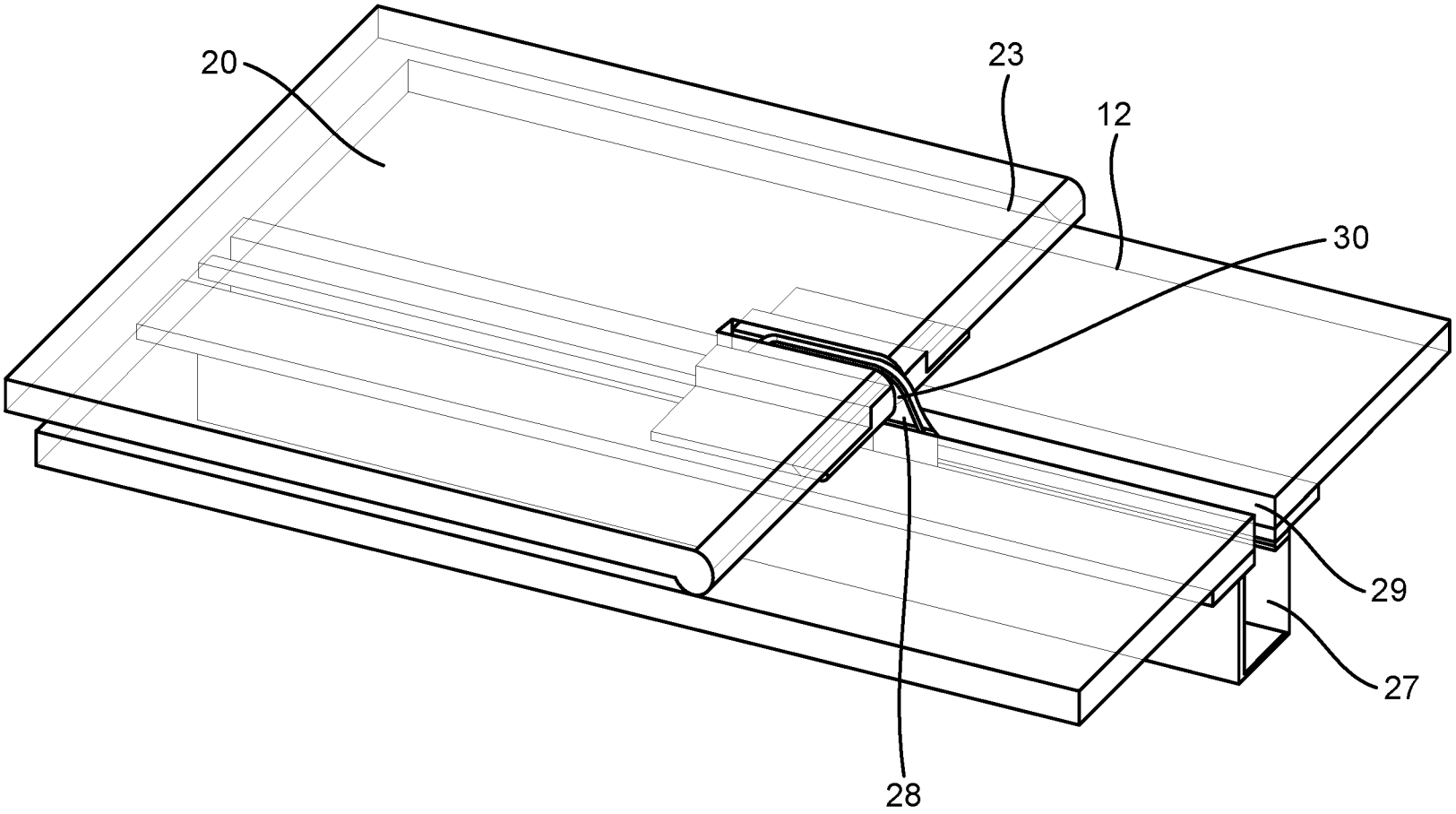
FIG. 6 is a perspective view of the slidable connection between a movable wall panel and a fixed wall panel according to an embodiment of the present disclosure, showing the movable wall panel in a first, retracted position.
Figure 7:
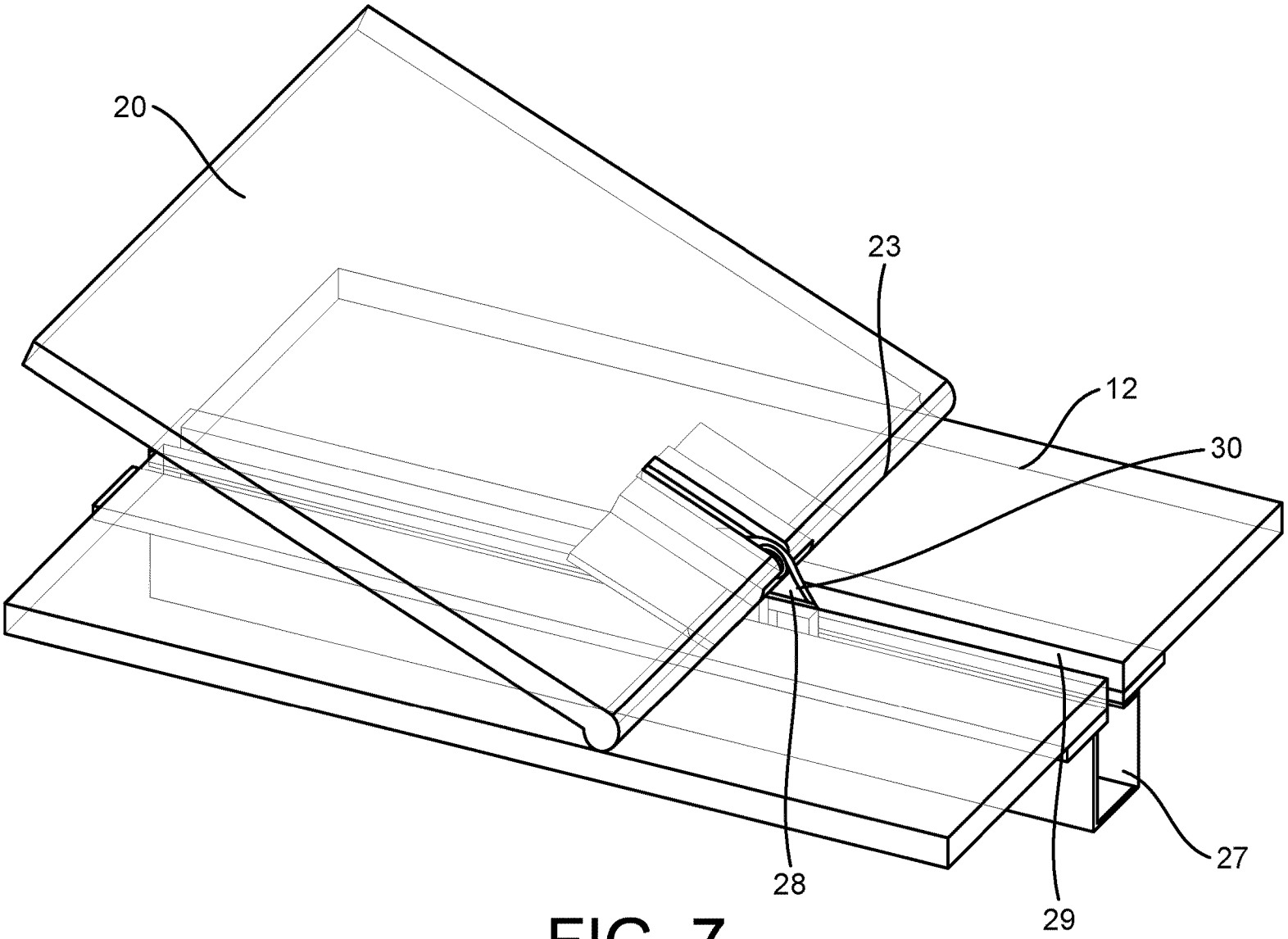
FIG. 7 is a perspective view of the slidable connection between a movable wall panel and a fixed wall panel of FIG. 6, showing the movable wall panel in a second, partially expanded position.

An example of slidable connection between the second side 23 of a moveable climbing panel 20 and the second wall portion 12 that utilizes a trolley 28 that moves along a track 27 is shown in detail in FIGS. 6-7. As shown in FIG. 6, the track is affixed to the rear of the second wall portion 12 and is accessible to the front of second wall portion by way of slot 29. The majority of trolley 28, e.g. the body of the trolley, is positioned within the track 27 and concealed from the front of the second wall portion 12. However, the trolley includes a mounting plate 30 that extends through the slot 29. The moveable wall panel 20, and more particularly the second side 23 of the moveable wall panel, is attached to a portion of mounting plate 30 that extends through the slot 29 and is thus positioned forward of the front face of second wall portion 12.

As shown in FIGS. 6-7, the moveable wall panel 20, and more particularly the second side 23 of the moveable wall panel, may be hingedly attached to the trolley 28, and more particularly to the mounting plate 30, so that in addition to being slidable along the front face of the second wall portion 12, the moveable wall panel is also rotatable such that it can be brought to a plurality of different angles with respect to the second wall portion. In some embodiments, the plurality of angles may include an angle of about zero degrees, e.g. as shown in FIG. 6. In some embodiments, the plurality of angles may include angles up to at least 45 degrees, alternatively up to at least 50 degrees, alternatively up to at least 60 degrees, alternatively up to at least 70 degrees, alternatively up to at least 80 degrees. In some embodiments, for example, the moveable wall panel 20 may be brought to substantially any angle between 0° and 45° with the second wall portion 12, substantially any angle between about 0° and 50° with the second wall portion, substantially any angle between about 0° and 60° with the second wall portion, substantially any angle between about 0° and 70° with the second wall portion, or substantially any angle between about 0° and 80° with the second wall portion. For reference, the angle between the moveable wall panel 20 and second wall portion 12 shown in FIG. 7 is about 22°.

As shown in FIGS. 6-7, the edge of the second side 23 of moveable wall panel 20 may have a rounded or circular cross-section in order to best facilitate rotation about the hinged connection with the trolley 28. Further, to enable rotation of the moveable wall panel 20 about the hinged connection with the trolley 28, a gap may be present between the front face of the second wall portion 12 and the movable wall panel 20.

This gap may be minimized in order to prevent objects from entering into it and/or a user from attempting to use the gap as a grip in a climbing activity. In some embodiments, for instance, the gap between the front face of the second wall portion 12 and the second side 23 of the movable panel 20 may be about one inch or less, alternatively about ¾-inch or less, alternatively about ½-inch or less. In some embodiments, for instance, the gap may be between about 1/16-inch and about ½-inch.

Figure 8:
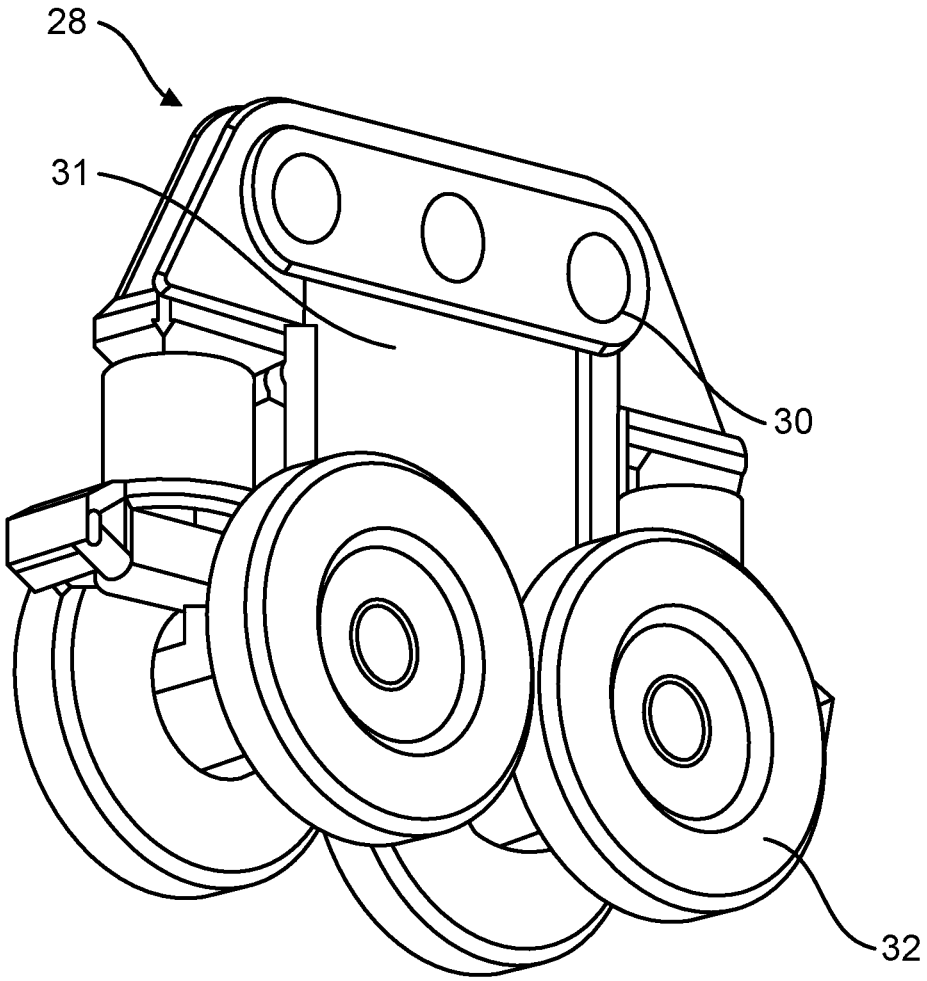
FIG. 8 is a perspective view of a trolley according to an embodiment of the present disclosure.

An example of a trolley 28 of the sort that can be used in the connection shown in FIGS. 6-7 is shown in FIG. 8. The trolley may include the previously-described mounting plate 30, a main body portion 31, and one or more, and desirably a plurality of rollers, e.g. wheels 32. The main body portion 31 may be positioned behind the second wall portion 12, e.g. within the track 27, and the wheel or plurality of wheels 32 may be configured to roll along one or more surfaces of the track. In the illustrated embodiment, each of wheels 32 is configured to roll along the surfaces of track 27 that are parallel with the second wall portion 12. In other embodiments, however, the trolley 28 may also have one or more wheels 32 or other rollers (e.g. ball bearings or the like) that are configured to roll along the surfaces of the track 27 that are perpendicular to the second wall portion 12, i.e. the side surfaces of track. In yet other embodiments, the trolley may not include any wheels or rollers, but may instead be configured to slide along track 27 by other known manners, including for example any of the slidable arrangements shown and/or described in US Patent Publication No. 2021/0245026 A1, the entirety of which is incorporated by reference herein.

Although the illustrated embodiment shows an operable connection between a track 27 accessible via slot 29 and trolley 28 having mounting plate 30 extending through the slot, other configurations are also contemplated without departing from the scope of the present disclosure. For example, a trolley 28 may be configured to slide along a larger track 27 and thus have multiple mounting plates 30 extending through multiple slots 29 formed in the second wall portion 12; etc.

Each track 27 and slot 29 combination spans between a first end 41 and a second end 42, with the second end being positioned closer to the first wall portion 11 than the first end. In the illustrated embodiment, the second end 42 is also positioned higher vertically than the first end 41. However, the exact design of the tracks 27 and slots 29 will depend on the desired orientation of the moveable wall panel 20 relative to the first and second wall portions 11, 12 when the moveable wall panel is in its closed and opened positions.

During operation of the climbing wall assembly 10 to bring the movable wall panel 20 to different positions, one or more of the actuators 115, 215 are operated to change the angle of first wall portion 11, second wall portion 12, or both, such that the relative angle between the first and second wall portions is increased or decreased. Changing the relative angle between the two wall portions will cause either (a) the second side 23 of the movable climbing panel 20 to move toward the first wall portion 11, bringing the movable climbing panel to more of an open position and increasing an area of the climbing surface that is exposed to a user, or (b) the second side 23 of the movable climbing panel 20 to move away from the first wall portion 11, bringing the movable climbing panel to more of a closed position and decreasing the area of the climbing surface that is exposed to a user. Changing the relative angle between the two wall portions will also cause the movable wall panel to pivot about (a) the hinged connection 24 with the first wall panel and (b) the hinged connection with trolley 28 (or other slidable element that brings about the above-described motion).

As the difference between the angle of first wall portion 11 and the angle of second wall portion 12 increases, the movable wall panel 20 will be moved into more of an opened position. As the difference between the angle of the first wall portion 11 and the angle of the second wall portion 12 decreases, i.e. as the two wall portions are brought closer together, the movable wall panel 20 will be moved into more of a closed position.

Figure 3:
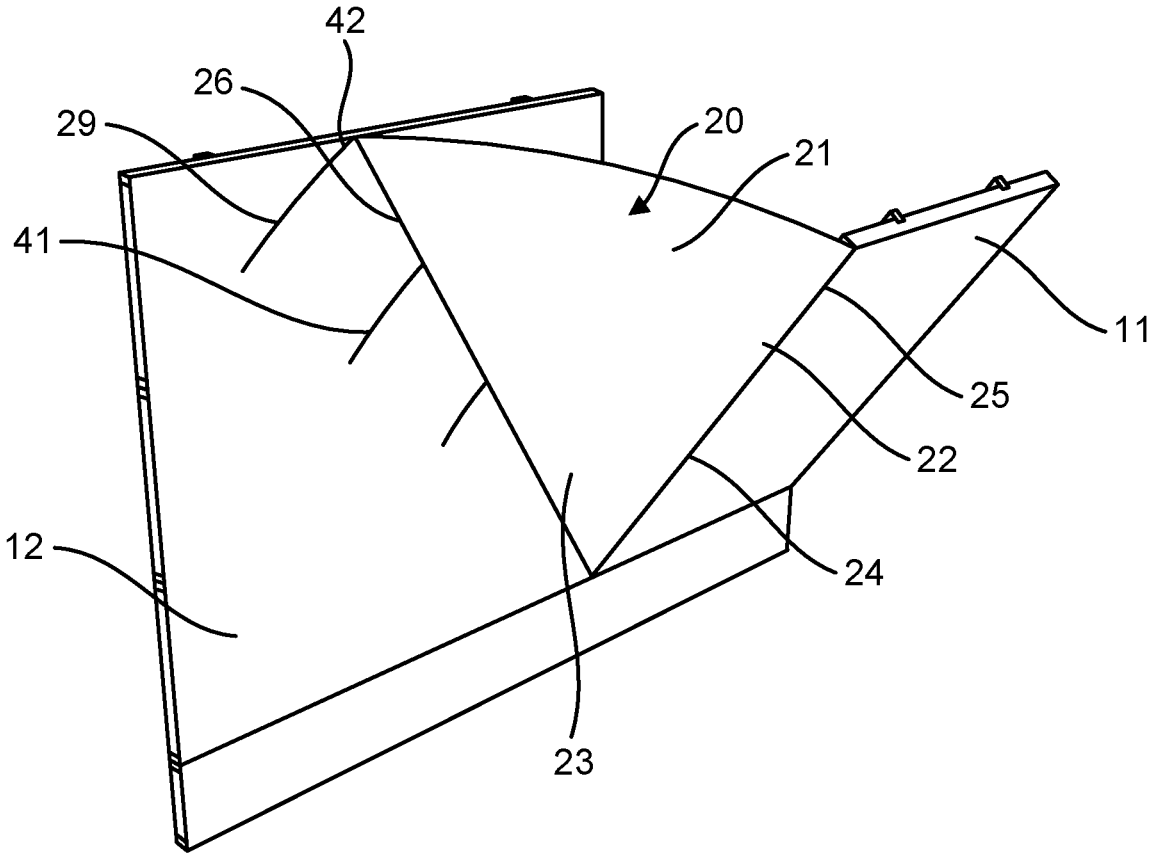
FIG. 3 is a front perspective view of the climbing wall assembly of FIG. 1, showing the movable panel in a second, partially expanded position.

This can be seen for example by comparing FIGS. 1-2 with FIGS. 3-4. In FIGS. 1-2, the first wall portion 11 and the second wall portion 12 are each positioned substantially vertically (i.e. at an angle of about 0° with a vertical axis) and movable climbing panel 20 is in a closed position. In FIGS. 3-4, on the other hand, actuator 115 has been operated so as to place the first wall portion 11 at a substantially maximum incline angle. The second wall portion 12, on the other hand, has not been moved and thus remains in a substantially vertical position. Accordingly, the difference in angle between the first wall portion 11 and the second wall portion 12 has been increased to a substantially maximum extent. This has moved the movable climbing panel 20 into a fully opened position.

More particularly, movement of the first wall portion 11 from a vertical orientation as shown in FIGS. 1-2 into an angled, i.e. non-vertical, orientation such as that shown in FIGS. 3-4 causes a number of things to occur. First, it causes the movable panel 20 to pivot, or rotate, about the hinged connection 24 between the first side 22 of the movable panel and the first wall portion 11. Second, it causes trolley 28 to slide within track 27, thereby bringing the second side 23 of the movable panel 20 closer to the first wall panel 11. Third, it causes the second side 23 of the movable panel 20 to pivot, or rotate, about the hinged connection between the second side of the movable panel and the trolley 28. All three of these movements can be seen for example by comparing FIG. 3 with FIG. 1.

These three movements in combination create a substantially continuous climbing surface having three distinct segments (the first wall portion 11, the movable panel 20, and the second wall portion 12), each of which is angled with respect to one another. Not only has the surface area of the climbing surface been increased when the movable wall portion 20 is brought to an opened position, therefore, but the climbing wall assembly 10 has been provided with a more challenging climbing surface made up of distinct segments having an angled relationship to one another. The exact angled relationships may be selected by control over the relative incline angles of the first and second wall portions 11, 12.

For instance, the first wall portion 11 may be brought to a greater or lesser angle with respect to vertical than that shown in FIG. 3, thereby changing the angular relationship between the movable climbing panel 20 and the first and second wall portions 11, 12. Moreover, though not illustrated, the actuator set 215 associated with the second wall portion 12 could also be operated to place the second wall portion 12 at different angles. This too, would change the angular relationship between the movable climbing panel 20 and the first and second wall portions 11, 12. Simply by controlling the two sets of actuators 115, 215, a substantially continuous climbing surface having a variety of different configurations, and offering a variety of different climbing challenges, may easily be obtained.

For example, movement of the second wall portion 12 downward toward the incline angle of the first wall portion shown in FIG. 3 would serve to reduce the angle between the three segments, bringing the movable climbing panel 20 into more of a closed position than that shown in FIG. 3. In fact, if the incline angle of the second wall portion 12 were brought to substantially the same incline as the first wall portion 11, the movable climbing panel 20 could be brought into a closed position at substantially any of a variety of incline angles. In such a configuration, the climbing surface formed by the first wall portion 11, the movable climbing panel 20, and the second climbing portion 12 may be caused to be substantially planar at substantially any angle within an overlap of the permitted ranges of incline for the first and second wall portions. In fact, if the actuators 115 and 215 were operated at the same time to bring the first wall portion 11 and the second wall portion 12 to the same angle of incline, the climbing wall assembly 10 may function akin to a conventional adjustable-incline climbing wall, with the movable wall panel 20 remaining in a closed position throughout.

To bring the movable wall panel 20 from an open position, such as that shown in FIGS. 3-4, to a closed position such as that shown in FIGS. 1-2, the incline angle of the first wall portion 11 relative to vertical may be reduced. Movement of the first wall portion 11 from an angle of incline such as that shown in FIGS. 3-4 back toward a vertical orientation such as that shown in FIGS. 1-2 causes a number of things to occur. First, it causes the movable panel 20 to pivot, or rotate, in the opposite direction about the hinged connection 24 between the first side 22 of the movable panel and the first wall portion 11. Second, it causes trolley 28 to slide the other direction within track 27, thereby bringing the second side 23 of the movable panel 20 farther from the first wall panel 11. Third, it causes the second side 23 of the movable panel 20 to pivot, or rotate, in the opposite direction about the hinged connection between the second side of the movable panel and the trolley 28. All three of these movements can be seen by comparing FIG. 1 with FIG. 3.

These three movements in combination create a substantially continuous climbing surface in which the segments (the first wall portion 11, the movable panel 20, and the second wall portion 12) become planar and substantially non-distinct from one another.

In the illustrated embodiment the closed position of the movable climbing panel 20 results in a climbing surface (produced by the surfaces of the first wall portion 11, the movable panel 20, and the second wall portion 12) that is substantially planar. In other words, in the closed position, the movable panel 20 is brought to an angle of about zero degrees with the first and second wall portions 11, 12. However, in other embodiments, this may not be the case. In some embodiments, for example, the first and second wall portions 11, 12 may be configured so that they cannot be brought to the same or substantially the same angle. Regardless, the movable climbing panel 20 is considered to be in a "closed" position when the relative angle of the first and second wall portions 11, 12 is at its minimum, i.e. when the incline angle of the first wall portion and the incline angle of the second wall portion are closest to one another, even though the result may not be a planar climbing surface. Similarly the movable climbing panel 20 is considered to be in a "fully opened" position when the relative angle between the first and second wall portions 11, 12 is at its maximum, despite the fact that the degree of that angle may differ significantly from that shown in the illustrated embodiment.

Moreover, though both the first and second wall portions 11, 12 of the illustrated embodiment are shown as being movable to a vertical or substantially vertical position, that may not be the case for other embodiments. In some embodiments, for example, the lowest incline angle of the first and second wall portions 11, 12 may be the same, but that angle may be greater than zero degrees relative to vertical, e.g. it may be about 5 degrees, about 10 degrees, about 15 degrees, about 20 degrees, etc. In yet other embodiments, the first wall portion 11 may have a minimum (or fixed) incline angle that is greater than the minimum (or fixed) incline angle of the second wall portion. For example, the first wall portion 11 may have a minimum (or fixed) incline angle that is greater than zero degrees relative to vertical (e.g. about 5 degrees, about 10 degrees, about 15 degrees, about 20 degrees, etc.) whereas the second wall portion 12 may have a minimum (or fixed) incline angle that is substantially vertical. Or the first wall portion may have a minimum (or fixed) incline angle that is 20 degrees relative to vertical, for example, whereas the second wall portion may have a minimum (or fixed) incline angle that is 5 degrees relative to vertical for example.

Further, while both the first wall portion 11 and the second wall portion 12 of the illustrated embodiment are adjustable-incline wall portions, one of the first and second wall portions may be fixed. In some embodiments, for example, the second wall portion 12 may be fixed (either at substantially vertical or an angle relative to vertical that is less than or equal to the minimum incline angle of the first wall portion) and the movable wall panel 20 may be moved between open and closed positions solely by controlling the incline angle of the first wall portion 11. In other embodiments, the first wall portion 11 may be fixed at a desired incline angle (greater than or equal to the maximum incline angle of the second wall portion) and the movable wall panel 20 may be moved between open and closed positions solely by controlling the incline angle of the second wall portion 12.

Figure 9:
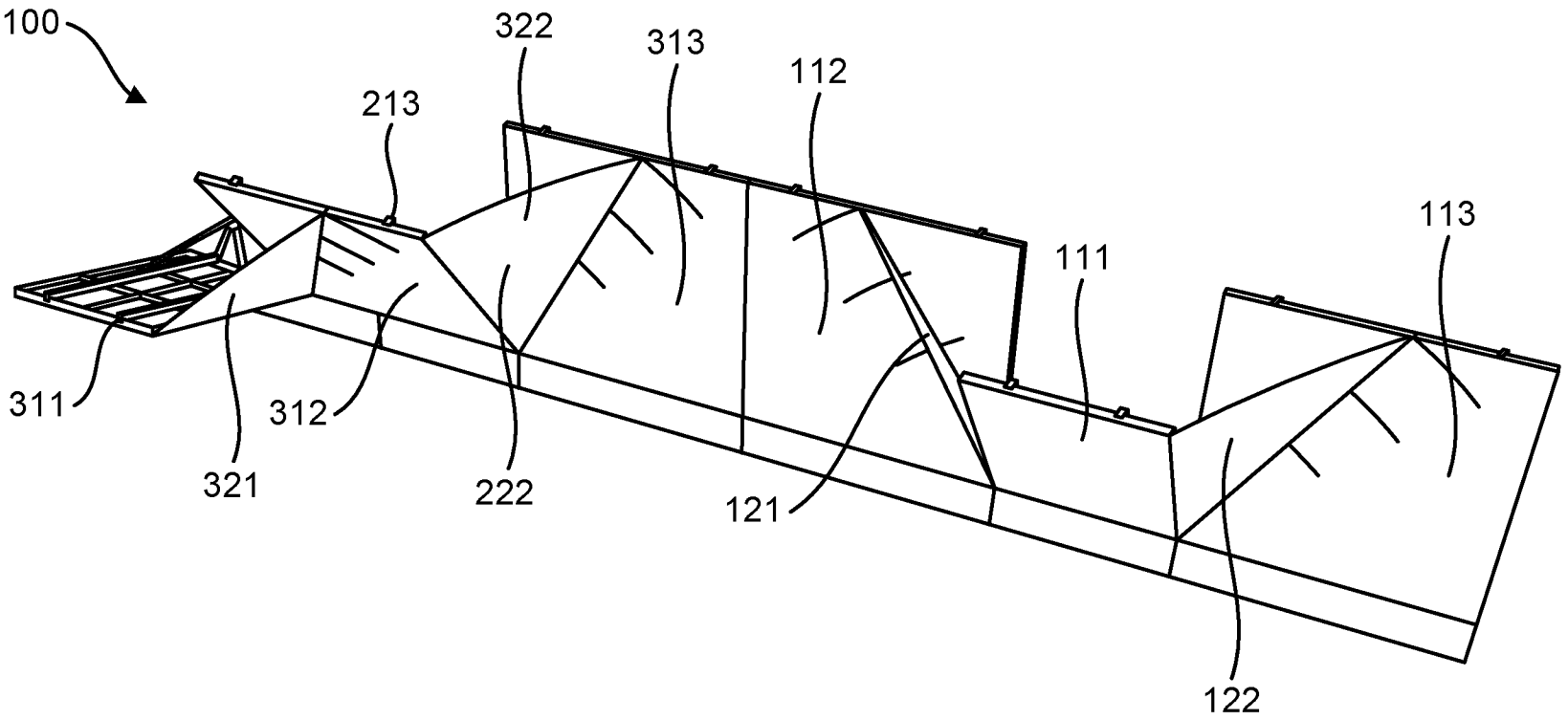
FIG. 9 is a front perspective view of a climbing wall assembly according to an embodiment of the present disclosure, showing a variety of arrangements of moveable wall panels along the same climbing surface.
Figure 10:
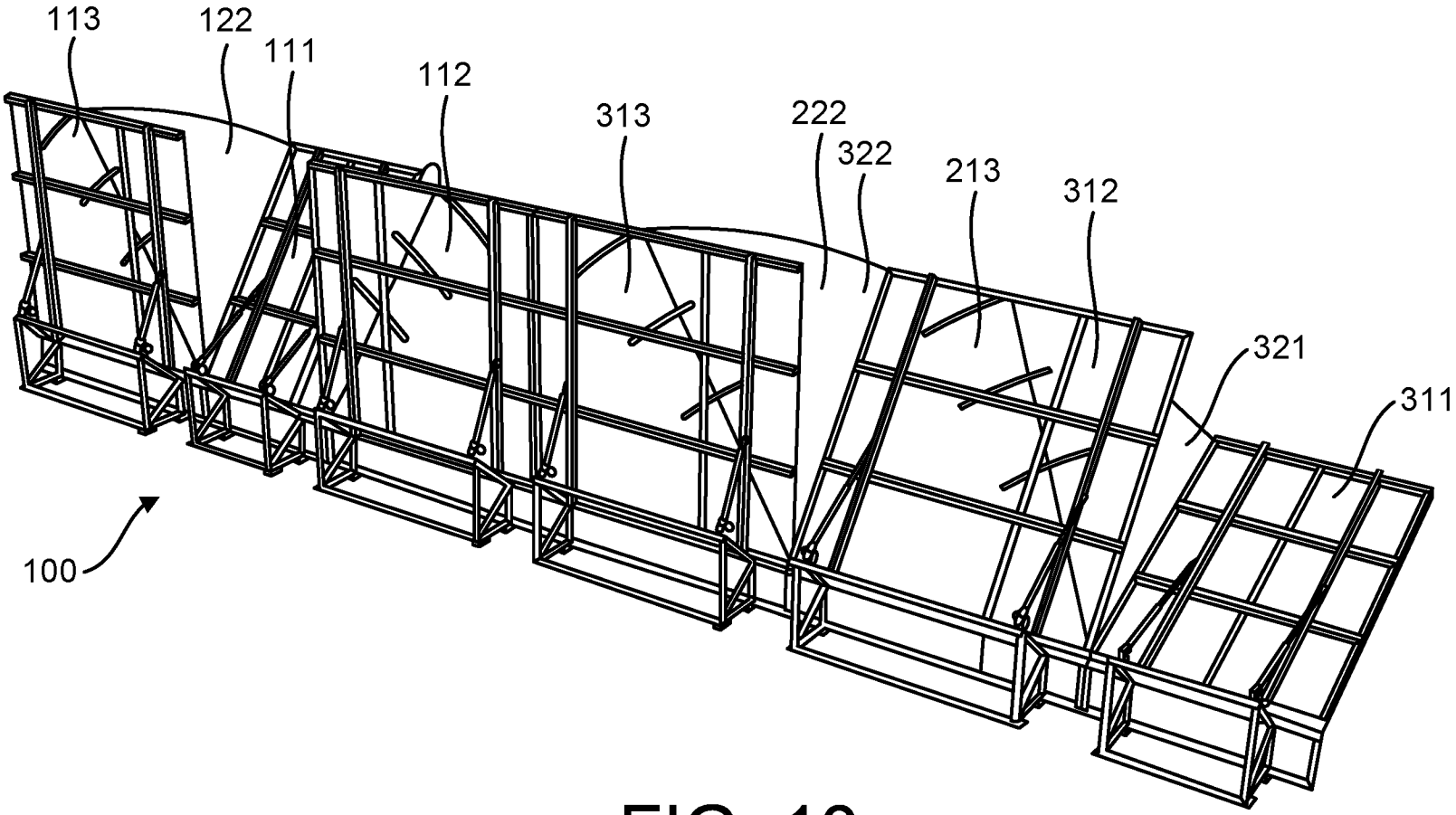
FIG. 10 is a rear perspective view of the climbing wall assembly of FIG. 9.
Figure 11:
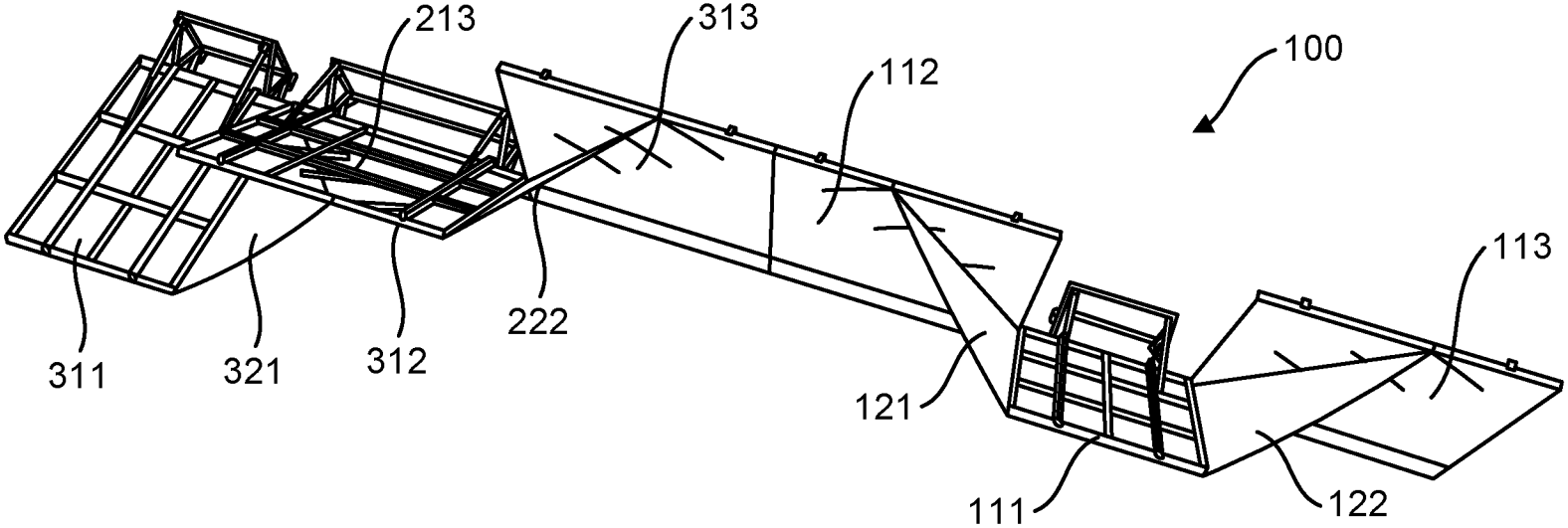
FIG. 11 is a top perspective view of the climbing wall assembly of FIG. 9.

In some embodiments, a plurality of movable climbing panels 20 can be incorporated into a single climbing wall 100, thereby providing a structure having a continuous climbing surface that can be placed into an almost-endless variety of different configurations. An example of a climbing wall 100 comprising a plurality of movable climbing panels 20 is shown in FIGS. 9-11. The climbing wall 100 shown in FIGS. 9-11 includes a number of different arrangements of climbing portions and movable climbing panels 20, any of which may be utilized alone or in any combination with any of the other arrangements.

As a first example, in some embodiments, a climbing wall 100 may include a first wall portion 111, a second wall portion 112, and a first movable climbing panel 121, which may operate as described above. The climbing wall 100 may also include a third wall portion 113 and a second movable climbing panel 122. The second movable climbing panel 122 may have a first side that is hingedly connected to the first wall portion 111 and a second side that is slidably and hingedly connected to the third wall portion 113. In other words, the second movable climbing panel 122 may link the third wall portion 113 to the first wall portion 111 in the same way that the first movable climbing panel 121 links the second wall portion 112 to the first wall portion. As illustrated, the third wall portion 113 and the second movable climbing panel 122 may be positioned on an opposite side of the first wall portion 111 from the second wall portion 112 and the first movable climbing panel 121.

The climbing wall 100 is configured so that (i) increasing an angle between the first wall portion 111 and the third wall portion 113 causes the second side of the second movable wall panel 122 to slide toward the first wall portion, thereby bringing the second movable wall panel into a more open position as shown in FIG. 9, and (ii) decreasing an angle between the first wall portion and the third wall portion causes the second side of the second movable wall panel to slide away from the first wall portion, thereby bringing the second movable wall panel into a more closed position. The third wall portion 113 may be an adjustable-incline wall portion or it may be a fixed wall portion. Regardless of the relative positions of the first wall portion 111, the third wall portion 113, and the second movable wall panel 122, a front face of the first wall portion, a front face of the third wall portion, and a front face of the second movable wall panel provide a substantially continuous climbing surface.

In such an embodiment, increasing the incline of the first wall portion 111 relative to both the second wall portion 112 and the third wall portion 113 may result in a continuous climbing surface such as that shown in FIGS. 9-11.

As a second example, a climbing wall 100 may include a first wall portion 111, a second wall portion 112, and a first movable climbing panel 121, which may operate as described above. The climbing wall 100 may also include a third wall portion 213 and a second movable climbing panel 222. The second movable climbing panel 222 may have a first side that is hingedly connected to the third wall portion 213 and a second side that is slidably and hingedly connected to the second wall portion 112. In other words, the second movable climbing panel 222 may link the third wall portion 213 to the second wall portion 112 in the same way that the first movable climbing panel 121 links the first wall portion 111 to the second wall portion. As illustrated, the third wall portion 213 and the second movable climbing panel 222 may be positioned on an opposite side of the second wall portion 112 from the first wall portion 111 and the first movable climbing panel 121.

The climbing wall 100 is configured so that (i) increasing an angle between the third wall portion 213 and the second wall portion 112 causes the second side of the second movable wall panel 222 to slide toward the third wall portion, thereby bringing the second movable wall panel into a more open position as shown in FIG. 9, and (ii) decreasing an angle between the third wall portion and the second wall portion causes the second side of the second movable wall panel to slide away from the third wall portion, thereby bringing the second movable wall panel into a more closed position. The third wall portion 213 may be an adjustable-incline wall portion or it may be a fixed wall portion. Regardless of the relative positions of the second wall portion 112, the third wall portion 213, and the second movable wall panel 222, a front face of the second wall portion, a front face of the third wall portion, and a front face of the second movable wall panel provide a substantially continuous climbing surface. Although the second wall portion 112 is illustrated in FIGS. 9-11 as being made up of two separately adjustable portions, it may also be a single adjustable or fixed wall portion.

As a third example, a climbing wall 100 may include a first wall portion 311, a second wall portion 312, and a first movable climbing panel 321, which may operate as described above. The climbing wall 100 may also include a third wall portion 313 and a second movable climbing panel 322. The second movable climbing panel 222 may have a first side that is hingedly connected to the second wall portion 312 and a second side that is slidably and hingedly connected to the third wall portion 313. In other words, the second movable climbing panel 222 may link the second wall portion 312 to the third wall portion 313 in the same way that the first movable climbing panel 321 links the first wall portion 311 to the second wall portion. As illustrated, the third wall portion 313 and the second movable climbing panel 322 may be positioned on an opposite side of the second wall portion 312 from the first wall portion 311 and the first movable climbing panel 321.

The climbing wall 100 is configured so that (i) increasing an angle between the second wall portion 312 and the third wall portion 313 causes the second side of the second movable wall panel 322 to slide toward the second wall portion, thereby bringing the second movable wall panel into a more open position as shown in FIG. 9, and (ii) decreasing an angle between the second wall portion and the third wall portion causes the second side of the second movable wall panel to slide away from the second wall portion, thereby bringing the second movable wall panel into a more closed position. The third wall portion 313 may be an adjustable-incline wall portion or it may be a fixed wall portion. Regardless of the relative positions of the second wall portion 312, the third wall portion 313, and the second movable wall panel 322, a front face of the second wall portion, a front face of the third wall portion, and a front face of the second movable wall panel provide a substantially continuous climbing surface.

It can be seen that the described embodiments provide a unique and novel climbing wall assembly 10 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A climbing wall assembly comprising:

a first wall portion;

a second wall portion;

one or more actuators configured to change an angle of
(a) the first wall portion,
(b) the second wall portion, or
(c) both (a) and (b);

a movable wall panel having a first side and a second side, the first side being hingedly connected to the first wall portion and the second side being slidably and hingedly connected to the second wall portion;

wherein the climbing wall is configured so that (i) increasing an angle between the first wall portion and the second wall portion causes the second side of the movable wall panel to slide toward the first wall portion, thereby bringing the movable wall panel toward an open position and (ii) decreasing an angle between the first wall portion and the second wall portion causes the second side of the movable wall panel to slide away from the first wall portion, thereby bringing the movable wall panel toward a closed position; and wherein a front face of the first wall portion, a front face of the second wall portion, and a front face of the movable wall panel provide a substantially continuous climbing surface throughout a range between the open position and the closed position of the movable wall panel.

2. The climbing wall of claim 1, wherein the one or more actuators are configured to change an angle of the first wall portion; and wherein increasing the angle of the first wall portion relative to vertical causes the second side of the movable wall panel to slide toward the first wall portion, and decreasing the angle of the first wall portion relative to vertical causes the second side of the movable wall panel to slide away from the first wall portion.

3. The climbing wall of claim 1, wherein the one or more actuators are configured to change an angle of the second wall portion; and wherein increasing the angle of the second wall portion relative to vertical causes the second side of the movable wall panel to slide away from the first wall portion, and decreasing the angle of the second wall portion relative to vertical causes the second side of the movable wall panel to slide toward the first wall portion.

4. The climbing wall of claim 1, wherein the one or more actuators comprise a first one or more actuators configured to change an angle of the first wall portion and a second one or more actuators configured to change an angle of the second wall portion; and wherein increasing the angle of the first wall portion relative to vertical causes the second side of the movable wall panel to slide toward the first wall portion, and decreasing the angle of the first wall portion relative to vertical causes the second side of the movable wall panel to slide away from the first wall portion; and wherein increasing the angle of the second wall portion relative to vertical causes the second side of the movable wall panel to slide away from the first wall portion, and decreasing the angle of the second wall portion relative to vertical causes the second side of the movable wall panel to slide toward the first wall portion.

5. The climbing wall of claim 1, wherein the second wall portion comprises one or more tracks and the movable wall panel comprises one or more gliders, each of the one or more gliders being configured to slide on one of the one or more tracks.

6. The climbing wall of claim 5, wherein the movable wall panel is hingedly connected to the one or more gliders.

7. The climbing wall of claim 5, wherein the one or more tracks span between a first end and a second end, the second end being positioned closer to the first wall portion than the first end and higher vertically than the first end.

8. The climbing wall of claim 5, wherein the one or more tracks are positioned on a rear of the second wall portion.

9. The climbing wall of claim 8, wherein the front face of the second wall portion comprises one or more slots, and wherein a portion of at least one of the one or more gliders extends through at least one of the one or more slots.

10. The climbing wall of claim 1, wherein the hinged connection comprises a piano hinge between the first side of the movable wall panel and an edge of the first wall portion.

11. The climbing wall of claim 1, wherein the hinged connection is inaccessible from the climbing surface.

12. The climbing wall of claim 11, further comprising a flexible cover that renders the hinged connection inaccessible from the climbing surface.

13. The climbing wall of claim 1, wherein the substantially continuous climbing surface is substantially planar when the second side of the movable wall panel is at its farthest location from the first wall portion.

14. The climbing wall of claim 1, wherein the substantially continuous climbing surface is at a maximum surface area when the second side of the movable wall panel is at its closest location to the first wall portion.

15. The climbing wall of claim 1, further comprising a gap between about one-sixteenth of an inch and about one-half of an inch between the front face of the second wall portion and the second side of the movable panel.

16. The climbing wall of claim 1, wherein the front face of each of the first wall portion, the second wall portion, and the movable panel comprises a plurality of apertures, each of which is configured to receive a climbing grip.

17. The climbing wall of claim 1, further comprising a plurality of climbing grips on the substantially continuous climbing surface.

18. The climbing wall of claim 2, further comprising a third wall portion;

one or more actuators configured to change an angle of the third wall portion; and a second movable wall panel having a first side and a second side, the first side being hingedly connected to the third wall portion and the second side being slidably and hingedly connected to the second wall portion;

wherein the climbing wall is configured so that (i) increasing an angle between the third wall portion and the second wall portion causes the second side of the second movable wall panel to slide toward the third wall portion, thereby bringing the second movable wall panel toward an open position, and (ii) decreasing an angle between the third wall portion and the second wall portion causes the second side of the second movable wall panel to slide away from the third wall portion, thereby bringing the second movable wall panel toward a closed position; and wherein the front face of the second wall portion, a front face of the third wall portion, and a front face of the second movable wall panel provide a substantially continuous climbing surface throughout a range between the open position and the closed position of the second movable wall panel.

19. The climbing wall of claim 3, further comprising a third wall portion; and a second movable wall panel having a first side and a second side, the first side being hingedly connected to the second wall portion and the second side being slidably and hingedly connected to the third wall portion;

wherein the climbing wall is configured so that (i) increasing an angle between the second wall portion and the third wall portion causes the second side of the second movable wall panel to slide toward the second wall portion, thereby bringing the second movable wall panel toward an open position, and (ii) decreasing an angle between the second wall portion and the third wall portion causes the second side of the second movable wall panel to slide away from the second wall portion, thereby bringing the second movable wall panel toward a closed position; and wherein the front face of the second wall portion, a front face of the third wall portion, and a front face of the second movable wall panel provide a substantially continuous climbing surface throughout a range between the open position and the closed position of the second movable wall panel.

20. The climbing wall of claim 2, further comprising a third wall portion;

a second movable wall panel having a first side and a second side, the first side being hingedly connected to the first wall portion and the second side being slidably and hingedly connected to the third wall portion;

wherein the climbing wall is configured so that (i) increasing an angle between the first wall portion and the third wall portion causes the second side of the second movable wall panel to slide toward the first wall portion, thereby bringing the second movable wall panel toward an open position, and (ii) decreasing an angle between the first wall portion and the third wall portion causes the second side of the second movable wall panel to slide away from the first wall portion, thereby bringing the second movable wall panel toward a closed position; and wherein the front face of the first wall portion, a front face of the third wall portion, and a front face of the second movable wall panel provide a substantially continuous climbing surface throughout a range between the open position and the closed position of the second movable wall panel.

* * * * *